US006908518B2

(12) United States Patent
Bouse et al.

(10) Patent No.: US 6,908,518 B2
(45) Date of Patent: Jun. 21, 2005

(54) NICKEL BASE SUPERALLOYS AND TURBINE COMPONENTS FABRICATED THEREFROM

(75) Inventors: Gregory Keith Bouse, Niskayuna, NY (US); Michael Francis Henry, Niskayuna, NY (US); Jon Conrad Schaeffer, Greenville, SC (US)

(73) Assignee: General Electric Company, Schenectady, NY (US)

( * ) Notice: Subject to any disclaimer, the term of this patent is extended or adjusted under 35 U.S.C. 154(b) by 130 days.

(21) Appl. No.: 10/158,134

(22) Filed: May 31, 2002

(65) Prior Publication Data

US 2003/0103862 A1 Jun. 5, 2003

Related U.S. Application Data

(62) Division of application No. 09/794,220, filed on Feb. 28, 2001, now abandoned.
(60) Provisional application No. 60/185,696, filed on Feb. 29, 2000.

(51) Int. Cl.[7] ..... C22F 1/10

(52) U.S. Cl. ..... 148/675

(58) Field of Search ..... 148/675, 555

(56) References Cited

U.S. PATENT DOCUMENTS

| | | | | |
|---|---|---|---|---|
| 4,169,742 A | * | 10/1979 | Wukusick et al. | 148/404 |
| 4,574,015 A | * | 3/1986 | Genereux et al. | 148/677 |
| 4,820,356 A | * | 4/1989 | Blackburn et al. | 148/675 |
| 5,143,563 A | * | 9/1992 | Krueger et al. | 148/410 |
| 5,154,884 A | * | 10/1992 | Wukusick et al. | 420/448 |
| 5,399,313 A | * | 3/1995 | Ross et al. | 420/448 |
| 5,470,371 A | * | 11/1995 | Darolia | 75/229 |

OTHER PUBLICATIONS

"39$^{th}$ GE Turbine State–of–the–Art Technology Seminar", Tab 1,""F" Technology—the First Half–Million Operating Hours", H.E. Miller, Aug. 1996.
"39th GE Turbine State–of–the–Art Technology Seminar", Tab 2, "GE Heavy–Duty Gas Turbine Performance Characteristics", F. J. Brooks, Aug. 1996.
"39th GE Turbine State–of–the–Art Technology Seminar", Tab 3, "9EC 50Hz 170–MW Class Gas Turbine", A. S. Arrao, Aug. 1996.
"39th GE Turbine State–of–the–Art Technology Seminar", Tab 4, "MWS6001FA—An Advanced–Technology 70–MW Hz Gas Turbine", Ramachandran et al., Aug. 1996.

(Continued)

*Primary Examiner*—Roy King
*Assistant Examiner*—Harry D. Wilkins, III
(74) *Attorney, Agent, or Firm*—Nixon & Vanderhye

(57) ABSTRACT

A nickel base superalloy suitable for the production of a large, crack-free nickel-base superalloy gas turbine bucket suitable for use in a large land-based utility gas turbine engine, comprising, by weight percents:

Chromium 7.0 to 12.0
Carbon 0.06 to 0.10
Cobalt 5.0 to 15.0
Titanium 3.0 to 5.0
Aluminum 3.0 to 5.0
Tungsten 3.0 to 12.0
Molybdenum 1.0 to 5.0
Boron 0.0080 to 0.01
Rhenium 0 to 10.0
Tantalum 2.0 to 6.0
Columbium 0 to 2.0
Vanadium 0 to 3.0
Hafnium 0 to 2.0 and remainder nickel and incidental impurities.

9 Claims, 8 Drawing Sheets

OTHER PUBLICATIONS

"39th GE Turbine State–of–the–Art Technology Seminar", Tab 5, "Turbomachinery Technology Advances at Nuovo Pignone", Benvenuti et al., Aug. 1996.
"39th GE Turbine State–of–the–Art Technology Seminar", Tab 6, "GE Aeroderivative Gas Turbines—Design and Operating Features", M.W. Horner, Aug. 1996.
"39th GE Turbine State–of–the–Art Technology Seminar", Tab 7, "Advance Gas Turbine Materials and Coatings", P.W. Schilke, Aug. 1996.
"39th GE Turbine State–of–the–Art Technology Seminar", Tab 8, "Dry Low $NO_X$ Combustion Systems for GE Heavy–Duty Turbines", L. B. Davis, Aug. 1996.
"39th GE Turbine State–of–the–Art Technology Seminar", Tab 9, "GE Gas Turbine Combustion Flexibility", M. A. Davi, Aug. 1996.
"39th GE Turbine State–of–the–Art Technology Seminar", Tab 10, "Gas Fuel Clean–Up System Design Considerations for GE Heavy–Duty Gas Turbines", C. Wilkes, Aug. 1996.
"39th GE Turbine State–of–the–Art Technology Seminar", Tab 11, "Integrated Control Systems for Advanced Combined Cycles", Chu et al., Aug. 1996.
"39th GE Turbine State–of–the–Art Technology Seminar", Tab 12, "Power Systems for the 21st Century "H" Gas Turbine Combined Cycles", Paul et al., Aug. 1996.
"39th GE Turbine State–of–the–Art Technology Seminar", Tab 13, "Clean Coat and Heavy Oil Technologies for Gas Turbines", D. M. Todd, Aug. 1996.
"39th GE Turbine State–of–the–Art Technology Seminar", Tab 14, "Gas Turbine Conversions, Modifications and Uprates Technology", Stuck et al., Aug. 1996.
"39th GE Turbine State–of–the–Art Technology Seminar", Tab 15, "Performance and Reliability Improvements for Heavy–Duty Gas Turbines, "J. R. Johnston, Aug. 1996.
"39th GE Turbine State–of–the–Art Technology Seminar", Tab 16, "Gas Turbine Repair Technology", Crimi et al, Aug. 1996.
"39th GE Turbine State–of–the–Art Technology Seminar", Tab 17, "Heavy Duty Turbine Operating & Maintenance Considerations", R. F. Hoeft, Aug. 1996.
"39th GE Turbine State–of–the–Art Technology Seminar", Tab 18, "Gas Turbine Performance Monitoring and Testing", Schmitt et al., Aug. 1996.
"39th GE Turbine State–of–the–Art Technology Seminar", Tab 19, "Monitoring Service Delivery System and Diagnostics", Madej et al., Aug. 1996.
"39th GE Turbine State–of–the–Art Technology Seminar", Tab 20, "Steam Turbines for Large Power Applications", Reinker et al., Aug. 1996.
"39th GE Turbine State–of–the–Art Technology Seminar", Tab 21, "Steam Turbines for Ultrasupercritical Power Plants", Retzlaff et al., Aug. 1996.
"39th GE Turbine State–of–the–Art Technology Seminar", Tab 22, "Steam Turbine Sustained Efficiency", P. Schofield, Aug. 1996.
"39th GE Turbine State–of–the–Art Technology Seminar", Tab 23, "Recent Advances in Steam Turbines for Industrial and Cogeneration Applications", Leger et al., Aug. 1996.
"39th GE Turbine State–of–the–Art Technology Seminar", Tab 24, "Mechanical Drive Steam Turbines", D. R. Leger, Aug. 1996.
"39th GE Turbine State–of–the–Art Technology Seminar", Tab 25, "Steam Turbines for STAG™ Combined–Cycle Power Systems", M. Boss, Aug. 1996.
"39th GE Turbine State–of–the–Art Technology Seminar", Tab 26, "Congeneration Application Considerations", Fisk et al., Aug. 1996.
"39th GE Turbine State–of–the–Art Technology Seminar", Tab 27, "Performance and Economic Considerations of Repowering Steam Power Plants", Stoll et al., Aug. 1996.
"39th GE Turbine State–of–the–Art Technology Seminar", Tab 28, "High–Power–Density™ Steam Turbine Design Evolution", J. H. Moore, Aug. 1996.
"39th GE Turbine State–of–the–Art Technology Seminar", Tab 29, "Advances in Steam Path Technologies", Cofer, IV, et al., Aug. 1996.
"39th GE Turbine State–of–the–Art Technology Seminar", Tab 30, "Upgradable Opportunities for Steam Turbines", D. R. Dreier, Jr., Aug. 1996.
"39th GE Turbine State–of–the–Art Technology Seminar", Tab 31, "Uprate Options for Industrial Turbines", R. C. Beck, Aug. 1996.
"39th GE Turbine State–of–the–Art Technology Seminar", Tab 32, "Thermal Performance Evaluation and Assessment of Steam Turbine Units", P. Albert, Aug. 1996.
"39th GE Turbine State–of–the–Art Technology Seminar", Tab 33, "Advances in Welding Repair Technology" J. F. Nolan, Aug. 1996.
"39th GE Turbine State–of–the–Art Technology Seminar", Tab 34, "Operation and Maintenance Strategies to Enhance Plant Profitability", MacGillivray et al., Aug. 1996.
"39th GE Turbine State–of–the–Art Technology Seminar", Tab 35, "Generator Insitu Inspections", D. Stanton.
"39th GE Turbine State–of–the–Art Technology Seminar", Tab 36, "Generator Upgrade and Rewind", Halpern et al., Aug. 1996.
"39th GE Turbine State–of–the–Art Technology Seminar", Tab 37, "GE Combined Cycle Product Line and Performance", Chase, et al., Aug. 1996.
"39th GE Turbine State–of–the–Art Technology Seminar", Tab 38, "GE Combined Cycle Experience", Maslak et al., Aug. 1996.
"39th GE Turbine State–of–the–Art Technology Seminar", Tab 39, "Single–Shaft Combined Cycle Power Generation Systems", Tomlinson et al., Aug. 1996.
"Advanced Turbine System Program—Conceptual Design and Product Development", Annual Report, Sep. 1, 1994–Aug. 31, 1995.
"Advanced Turbine System (ATS Program) Conceptual Design and Product Development", Final Technical Progress Report, vol. 2– Industrial Machine, Mar. 31, 1997, Morgantown, WV.
"Advanced Turbine Systems (ATS Program), Conceptual Design and Product Development", Final Technical Progress Report, Aug. 31, 1996, Morgantown, WV.
"Advanced Turbine Systems (ATS) Program, Phase 2, Conceptual Design and Product Development", Yearly Technical Progress Report, Reporting Period: Aug. 25, 1993–Aug. 31, 1994.
"Advanced Turbine Systems" Annual Program Review, Preprints, Nov. 2–4, 1998, Washington, D.C. U.S. Department of Energy, Office of Industrial Technologies Federal Energy Technology Center.
"ATS Conference" Oct. 28, 1999, Slide Presentation.
"Baglan Bay Launch Site", various articles relating to Baglan Energy Park.
"Baglan Energy Park", Brochure.

"Commercialization", Del Williamson, Present, Global Sales, May 8, 1998.
"Environmental, Health and Safety Assessment: ATS 7H Program (Phase 3R) Test Activities at the GE Power Systems Gas Turbine Manufacturing Facility, Greenville, SC", Document #1753, Feb. 1998, Publication Date: Nov. 17, 1998, Report Nos. DE–FC21–95MC31176—11.
"Exhibit panels used at 1995 product introduction at PowerGen Europe".
"Extensive Testing Program Validates High Efficiency, reliability of GE's Advanced "H" Gas Turbine Technology", Press Information, Press Release, 96–NR14, Jun. 26, 1996, H Technology Tests/pp. 1–4.
"Extensive Testing Program Validates High Efficiency, Reliability of GE's Advanced "H" Gas Turbine Technology", GE Introduces Advanced Gas Turbine Technology Platform: First to Reach 60% Combined–Cycle Power Plant Efficiency, Press Information, Press Release, Power–Gen Europe '95, 95–NRR15, Advanced Technology Introduction/pp. 1–6.
"Gas, Steam Turbine Work as Single Unit in GE's Advanced H Technology Combined–Cycle System", Press Information, Press Release, 95–NR18, May 16, 1995, Advanced Technology Introduction/pp. 1–3.
"GE Breaks 60% Net Efficiency Barrier" paper, 4 pages.
"GE Businesses Share Technologies and Experts to Develop State–Of–The–Art Products", Press Information, Press Release 95–NR10, May 16, 1995, GE Technology Transfer/pp. 1–3.
"General Electric ATS Program Technical Review, Phase 2 Activities", T. Chance et al., pp. 1–4.
"General Electric's DOE/ATS H Gas Turbine Development" Advanced Turbine Systems Annual Review Meeting, Nov. 7–8, 1996, Washington, D.C., Publication Release.
"H Technology Commercialization", 1998 MarComm Activity Recommendation, Mar., 1998.
"H Technology", Jon Ebacher, VP, Power Gen Technology, May 8, 1998.
"H Testing Process", Jon Ebacher, VP, Power Gen Technology, May 8, 1998.
"Heavy–Duty & Aeroderivative Products" Gas Turbines, Brochure, 1998.
"MS7001H/MS9001H Gas Turbine, gepower.com website for PowerGen Europe" Jun. 1–3 going public Jun. 15, (1995).
"New Steam Cooling System is a Key to 60% Efficiency For GE "H" Technology Combined–Cycle Systems", Press Information, Press Release, 95–NRR16, May 16, 1995, H Technology/pp. 1–3.
"Overview of GE's H Gas Turbine Combined Cycle", Jul. 1, 1995 to Dec. 31, 1997.
"Power Systems for the 21st Century—"H" Gas Turbine Combined Cycles", Thomas C. Paul et al., Report.
"Power–Gen '96 Europe", Conference Programme, Budapest, Hungary, Jun. 26–28, 1996.
"Power–Gen International", 1998 Show Guide, Dec. 9–11, 1998, Orange County Convention Center, Orlando, Florida.
"Press Coverage following 1995 product announcement"; various newspaper clippings relating to improved generator.
"Proceedings of the Advanced Turbine Systems Annual Program Review Meeting", vol. I, "Industrial Advanced Turbine Systems Program Overview", D.W. Esbeck, p. 3–13, Oct., 1995.
"Proceedings of the Advanced Turbine Systems Annual Program Review Meeting", vol. I, "H Gas Turbine Combined Cycle", J. Corman, p. 14–21, Oct., 1995.
"Proceedings of the Advanced Turbine Systems Annual Program Review Meeting", vol. I, "Overview of Westinghouse's Advanced Turbine Systems Program", Bannister et al., p. 22–30, Oct., 1995.
"Proceedings of the Advanced Turbine Systems Annual Program Review Meeting", vol. I, "Allison Engine ATS Program Technical Review", D. Mukavetz, p. 31–42, Oct., 1995.
"Proceedings of the Advanced Turbine Systems Annual Program Review Meeting", vol. I, "Advanced Turbine Systems Program Industrial System Concept Development", S. Gates, p. 43–63, Oct., 1995.
"Proceedings of the Advanced Turbine Systems Annual Program Review Meeting", vol. I, "Advanced Turbine System Program Phase 2 Cycle Selection", Latcovich, Jr., p. 64–69, Oct., 1995.
"Proceedings of the Advanced Turbine Systems Annual Program Review Meeting", vol. I, "General Electric ATS Program Technical Review Phase 2 Activities", Chance et al., p. 70–74, Oct., 1995.
"Proceedings of the Advanced Turbine Systems Annual Program Review Meeting", vol. I, "Technical Review of Westinghouse's Advanced Turbine Systems Program", Diakunchak et al., p. 75–86, Oct., 1995.
"Proceedings of the Advanced Turbine Systems Annual Program Review Meeting", vol. I, "Advanced Combustion Turbines and Cycles: An EPRI Perspective", Touchton et al., p. 87–88, Oct., 1995.
"Proceedings of the Advanced Turbine Systems Annual Program Review Meeting", vol. I, "Advanced Turbine Systems Annual Program Review", William E. Koop, p. 89–92, Oct., 1995.
"Proceedings of the Advanced Turbine Systems Annual Program Review Meeting", vol. I, "The AGTSR Consortium: An Update", Fant et al., p. 93–102, Oct., 1995.
"Proceedings of the Advanced Turbine Systems Annual Program Review Meeting", vol. I, "Overview of Allison/AGTSR Interactions", Sy A. Ali, p. 103–106, Oct., 1995.
"Proceedings of the Advanced Turbine Systems Annual Program Review Meeting", vol. I, "Design Factors for Stable Lean Premix Combustion", Richards et al., p. 107–113, Oct., 1995.
"Proceedings of the Advanced Turbine Systems Annual Program Review Meeting", vol. I, "Ceramic Stationary as Turbine", M. van Roode, p. 114–147, Oct., 1995.
"Proceedings of the Advanced Turbine Systems Annual Program Review Meeting", vol. I, "DOE/Allison Ceramic Vane Effort", Wenglarz et al., p. 148–151, Oct., 1995.
"Proceedings of the Advanced Turbine Systems Annual Program Review Meeting", vol. I, "Materials/Manufacturing Element of the Advanced Turbine Systems Program", Karnitz et al., p. 152–160, Oct., 1995.
"Proceedings of the Advanced Turbine Systems Annual Program Review Meeting", vol. I, "Land–Based Turbine Casting Initiative", Mueller et al., p. 161–170, Oct., 1995.
"Proceedings of the Advanced Turbine Systems Annual Program Review Meeting", vol. I, "Turbine Airfoil Manufacturing Technology", Kortovich, p. 171–181, Oct., 1995.

"Proceedings of the Advanced Turbine Systems Annual Program Review Meeting", vol. I, "Pratt & Whitney Thermal Barrier Coatings", Bornstein et al., p. 182–193, Oct., 1995.

"Proceedings of the Advanced Turbine Systems Annual Program Review Meeting", vol. I, "Westinhouse Thermal Barrier Coatings", Goedjen et al., p. 194–199, Oct., 1995.

"Proceedings of the Advanced Turbine Systems Annual Program Review Meeting", vol. I, "High Performance Steam Development", Duffy et al., p. 200–220, Oct., 1995.

"Proceedings of the Advanced Turbine Systems Annual Program Review Meeting", vol. II, "Lean Premixed Combustion Stabilized by Radiation Feedback and heterogeneous Catalysis", Dibble et al., p. 221–232, Oct., 1995.

"Proceedings of the Advanced Turbine Systems Annual Program Review Meeting", vol. II, "Rayleigh/Raman/LIF Measurements in a Turbulent Lean Premixed Combustor", Nandula et al. p. 233–248, Oct., 1995.

"Proceedings of the Advanced Turbine Systems Annual Program Review Meeting", vol. II, "Lean Premixed Flames for Low $No_X$ Combustors", Sojka et al., p. 249–275, Oct., 1995.

"Proceedings of the Advanced Turbine Systems Annual Program Review Meeting", vol. II, "Functionally Gradient Materials for Thermal Barrier Coatings in Advanced Gas Turbine Systems", Banovic et al., p. 276–280, Oct., 1995.

"Proceedings of the Advanced Turbine Systems Annual Program Review Meeting", vol. II, "Advanced Turbine Cooling, Heat Transfer, and Aerodynamic Studies", Han et al., p. 281–309, Oct., 1995.

"Proceedings of the Advanced Turbine Systems Annual Program Review Meeting", vol. II, "Life Prediction of Advanced Materials for Gas Turbine Application", Zamrik et al., p. 310–327, Oct., 1995.

"Proceedings of the Advanced Turbine Systems Annual Program Review Meeting", vol. II, "Advanced Combustion Technologies for Gas Turbine Power Plants", Vandsburger et al., p. 328–352, Oct., 1995.

"Proceedings of the Advanced Turbine Systems Annual Program Review Meeting", vol. II, "Combustion Modeling in Advanced Gas Turbine Systems", Smoot et al., p. 353–370, Oct., 1995.

"Proceedings of the Advanced Turbine Systems Annual Program Review Meeting", vol. II, "Heat Transfer in a Two–Pass Internally Ribbed Turbine Blade Coolant Channel with Cylindrical Vortex Generators", Hibbs et al. p. 371–390, Oct., 1995.

"Proceedings of the Advanced Turbine Systems Annual Program Review Meeting", vol. II, "Rotational Effects on Turbine Blade Cooling", Govatzidakia et al., p. 391–392, Oct., 1995.

"Proceedings of the Advanced Turbine Systems Annual Program Review Meeting", vol. II, "Manifold Methods for Methane Combustion", Yang et al., p. 393–409, Oct., 1995.

"Proceedings of the Advanced Turbine Systems Annual Program Review Meeting", vol. II, "Advanced Multistage Turbine Blade Aerodynamics, Performance, Cooling, and Heat Transfer", Fleeter et al., p. 410–414, Oct., 1995.

"Proceedings of the Advanced Turbine Systems Annual Program Review Meeting, vol. II", The Role of Reactant Unmixedness, Strain Rate, and Length Scale on Premixed Combustor Performance, Samuelsen et al., p. 415–422, Oct., 1995.

"Proceedings of the Advanced Turbine Systems Annual Program Review Meeting", vol. II, "Experimental and Computational Studies of Film Cooling With Compound Angle Injection", Goldstein et al., p. 423–451, Oct., 1995.

"Proceedings of the Advanced Turbine Systems Annual Program Review Meeting", vol. II, "Compatibility of Gas Turbine Materials with Steam Cooling", Desai et al., p. 452–464, Oct., 1995.

"Proceedings of the Advanced Turbine Systems Annual Program Review Meeting", vol. II, "Use of a Laser–Induced Fluorescence Thermal Imaging System for Film Cooling Heat Transfer Measurement", M. K. Chyu, p. 465–473, Oct., 1995.

"Proceedings of the Advanced Turbine Systems Annual Program Review Meeting", vol. II, Effects of Geometry on Slot–Jet Film Cooling Performance, Hyams et al., p. 474–496 Oct., 1995.

"Proceedings of the Advanced Turbine Systems Annual Program Review Meeting", vol. II, "Steam as Turbine Blade Coolant: Experimental Data Generation", Wilmsen et al., p. 497–505, Oct., 1995.

"Proceedings of the Advanced Turbine Systems Annual Program Review Meeting", vol. II, "Combustion Chemical Vapor Deposited Coatings for Thermal Barrier Coating Systems", Hampikian et al., p. 506–515, Oct., 1995.

"Proceedings of the Advanced Turbine Systems Annual Program Review Meeting", vol. II, "Premixed Burner Experiments: Geometry, Mixing, and Flame Structure Issues", Gupta et al., p. 516–528, Oct., 1995.

"Proceedings of the Advanced Turbine Systems Annual Program Review Meeting", vol. II, "Intercooler Flow Path for Gas Turbines: CFD Design and Experiments", Agrawal et al., p. 529–538, Oct., 1995.

"Proceedings of the Advanced Turbine Systems Annual Program Review Meeting", vol. II, "Bond Strength and Stress Measurements in Thermal Barrier Coatings", Gell et al., p. 539–549, Oct., 1995.

"Proceedings of the Advanced Turbine Systems Annual Program Review Meeting", vol. II, "Active Control of Combustion Instabilities in Low $NO_X$ Gas Turbines", Zinn et al., p. 550–551, Oct., 1995.

"Proceedings of the Advanced Turbine Systems Annual Program Review Meeting", vol. II, "Combustion Instability Modeling and Analysis", Santoro et al., p. 552–559, Oct., 1995.

"Proceedings of the Advanced Turbine Systems Annual Program Review Meeting", vol. II, "Flow and Heat Transfer in Gas Turbine Disk Cavities Subject to Nonuniform External Pressure Field", Roy et al., p. 560–565, Oct., 1995.

"Proceedings of the Advanced Turbine Systems Annual Program Review Meeting", vol. II, "Heat Pipe Turbine Vane Cooling", Langston et al., p. 566–572, Oct., 1995.

"Proceedings of the Advanced Turbine Systems Annual Program Review Meeting", vol. II, "Improved Modeling Techniques for Turbomachinery Flow Fields", Lakshminarayana et al., p. 573–581, Oct., 1995.

"Proceedings of the Advanced Turbine Systems Annual Program Review Meeting", vol. II, "Advanced 3D Inverse Method for Designing Turbomachine Blades", T. Dang, p. 582, Oct., 1995.

"Proceedings of the Advanced Turbine Systems Annual Program Review Meeting", "ATS and the Industries of the Future", Denise Swink, p. 1, Nov., 1996.

"Proceedings of the Advanced Turbine Systems Annual Program Review Meeting", "Gas Turbine Association Agenda", William H. Day, p. 3–16, Nov., 1996.

"Proceedings of the Advanced Turbine Systems Annual Program Review Meeting", "Power Needs in the Chemical Industry", Keith Davidson, p. 17–26, Nov., 1996.

"Proceedings of the Advanced Turbine Systems Annual Program Review Meeting", "Advanced Turbine Systems Program Overview", David Esbeck, p. 27–34, Nov., 1996.

"Proceedings of the Advanced Turbine Systems Annual Program Review Meeting", "Westinghouse's Advanced Turbine Systems Program", Gerard McQuiggan, p. 35–48, Nov., 1996.

"Proceedings of the Advanced Turbine Systems Annual Program Review Meeting", "Overview of GE's H Gas Turbine Combined Cycle", Cook et al., p. 49–72, Nov., 1996.

"Proceedings of the Advanced Turbine Systems Annual Program Review Meeting", "Allison Advanced Simple Cycle Gas Turbine System", William D. Weisbrod, p. 73–94, Nov., 1996.

"Proceedings of the Advanced Turbine Systems Annual Program Review Meeting", "The AGTSR Industry–University Consortium", Lawrence P. Golan, p. 95–110, Nov., 1996.

"Proceedings of the Advanced Turbine Systems Annual Program Review Meeting", "$NO_X$ and CO Emissions Models for Gas–Fired Lean–Premixed Combustion Turbines", A. Mellor, p. 111–122, Nov., 1996.

"Proceedings of the Advanced Turbine Systems Annual Program Review Meeting", "Methodologies for Active Mixing and Combustion Control", Uri Vandsburger, p. 123–156, Nov., 1996.

"Proceedings of the Advanced Turbine Systems Annual Program Review Meeting", "Combustion Modeling in Advanced Gas Turbine Systems", Paul O. Hedman, p. 157–180, Nov., 19967.

"Proceedings of the Advanced Turbine Systems Annual Program Review Meeting", "Manifold Methods for Methane Combustion", Stephen B. Pope, p. 181–188, Nov., 1996.

"Proceedings of the Advanced Turbine Systems Annual Program Review Meeting", "The Role of Reactant Unmixedness, Strain Rate, and Length Scale on Premixed Combustor Performance", Scott Samuelsen, p. 189–210, Nov., 1996.

"Proceedings of the Advanced Turbine Systems Annual Program Review Meeting", "Effect of Swirl and Momentum Distribution on Temperature Distribution in Premixed Flames", Ashwani K. Gupta, p. 211–232, Nov., 1996.

"Proceedings of the Advanced Turbine Systems Annual Program Review Meeting", "Combustion Instability Studies Application to Land–Based Gas Turbine Combustors", Robert J. Santoro, p. 233–252.

"Proceedings of the Advanced Turbine Systems Annual Program Review Meeting", Active Control of Combustion Instabilities in Low $NO_X$ Turbines, Ben T. Zinn, p. 253–264, Nov., 1996.

"Proceedings of the Advanced Turbine Systems Annual Program Review Meeting", "Life Prediction of Advanced Materials for Gas Turbine Application," Sam Y. Zamrik, p. 265–274, Nov., 1996.

"Proceedings of the Advanced Turbine Systems Annual Program Review Meeting", "Combustion Chemical Vapor Deposited Coatings for Thermal Barrier Coating Systems", W. Brent Carter, p. 275–290, Nov., 1996.

"Proceedings of the Advanced Turbine Systems Annual Program Review Meeting", "Compatibility of Gas Turbine Materials with Steam Cooling", Vimal Desai, p. 291–314, Nov., 1996.

"Proceedings of the Advanced Turbine Systems Annual Program Review Meeting", "Bond Strength and Stress Measurements in Thermal Barrier Coatings", Maurice Gell, p. 315–334, Nov., 1996.

"Proceedings of the Advanced Turbine Systems Annual Program Review Meeting", "Advanced Multistage Turbine Blade Aerodynamics, Performance, Cooling and Heat Transfer", Sanford Fleeter, p. 335–356, Nov., 1996.

"Proceedings of the Advanced Turbine Systems Annual Program Review Meeting", "Flow Characteristics of an Intercooler System for Power Generating Gas Turbines", Ajay K. Agrawal, p. 357–370, Nov., 1996.

"Proceedings of the Advanced Turbine Systems Annual Program Review Meeting", "Improved Modeling Techniques for Turbomachinery Flow Fields", B. Lakshiminarayana, p. 371–392, Nov., 1996.

"Proceedings of the Advanced Turbine Systems Annual Program Review Meeting", "Development of an Advanced 3d & Viscous Aerodynamic Design Method for Turbomachine Components in Utility and Industrial Gas Turbine Applications", Thong Q. Dang, p. 393–406, Nov., 1996.

"Proceedings of the Advanced Turbine Systems Annual Program Review Meeting", "Advanced Turbine Cooling, Heat Transfer, and Aerodynamic Studies", Je–Chin Han, p. 407–426, Nov., 1996.

"Proceedings of the Advanced Turbine Systems Annual Program Review Meeting", "Heat Transfer in a Two–Pass Internally Ribbed Turbine Blade Coolant Channel with Vortex Generators", S. Acharya, p. 427–446.

"Proceedings of the Advanced Turbine Systems Annual Program Review Meeting", "Experimental and Computational Studies of Film Cooling with Compound Angle Injection", R. Goldstein, p. 447–460, Nov., 1996.

"Proceedings of the Advanced Turbine Systems Annual Program Review Meeting", "Study of Endwall Film Cooling with a Gap Leakage Using a Thermographic Phosphor Fluorescence Imaging System", Mingking K. Chyu, p. 461–470, Nov., 1996.

"Proceedings of the Advanced Turbine Systems Annual Program Review Meeting", "Steam as a Turbine Blade Coolant: External Side Heat Transfer", Abraham Engeda, p. 471–482, Nov., 1996.

"Proceedings of the Advanced Turbine Systems Annual Program Review Meeting", "Flow and Heat Transfer in Gas Turbine Disk Cavities Subject to Nonuniform External Pressure Field", Ramendra Roy, p. 483–498, Nov., 1996.

"Proceedings of the Advanced Turbine Systems Annual Program Review Meeting", "Closed–Loop Mist/Steam Cooling for Advanced Turbine Systems", Ting Wang, p. 499–512, Nov., 1996.

"Proceedings of the Advanced Turbine Systems Annual Program Review Meeting", "Heat Pipe Turbine Vane Cooling", Langston et al., p. 513–534, Nov., 1996.

"Proceedings of the Advanced Turbine Systems Annual Program Review Meeting", "EPRI's Combustion Turbine Program: Status and Future Directions", Arthur Cohn, p. 535–552 Nov., 1996.
"Proceedings of the Advanced Turbine Systems Annual Program Review Meeting", "ATS Materials Support", Michael Karnitz, p. 553–576, Nov., 1996.
"Proceedings of the Advanced Turbine Systems Annual Program Review Meeting", "Land Based Turbine Casting Initiative", Boyd A. Mueller, p. 577–592, Nov., 1996.
"Proceedings of the Advanced Turbine Systems Annual Program Review Meeting", "Turbine Airfoil Manufacturing Technology", Charles S. Kortovich, p. 593–622, Nov., 1996.
"Proceedings of the Advanced Turbine Systems Annual Program Review Meeting", "Hot Corrosion Testing of TBS's", Norman Bornstein, p. 623–631, Nov., 1996.
"Proceedings of the Advanced Turbine Systems Annual Program Review Meeting", "Ceramic Stationary Gas Turbine", Mark van Roode, p. 633–658, Nov., 1996.
"Proceedings of the Advanced Turbine Systems Annual Program Review Meeting", "Western European Status of Ceramics for Gas Turbines", Tibor Bornemisza, p. 659–670, Nov., 1996.
"Proceedings of the Advanced Turbine Systems Annual Program Review Meeting", "Status of Ceramic Gas Turbines in Russia", Mark van Roode, p. 671, Nov., 1996.
"Status Report: The U.S. Department of Energy's Advanced Turbine systems Program", facsimile dated Nov. 7, 1996.
"Testing Program Results Validate GE's H Gas Turbine—High Efficiency, Low Cost of Electricity and Low Emissions", Roger Schonewald and Patrick Marolda, (no date available).
"Testing Program Results Validate GE's H Gas Turbine—High Efficiency, Low Cost of Electricity and Low Emissions", Slide Presentation—working draft, (no date available).
"The Next Step In H . . . For Low Cost Per kW–Hour Power Generation", LP–1 PGE '98.
"Utility Advanced Turbine System (ATS) Technology Readiness Testing and Pre–Commercialization Demonstration", Document #486040, Oct. 1–Dec. 31, 1996, Publication Date, Jun. 1, 1997, Report Nos.: DOE/MC/31176—5628.
"Utility Advanced Turbine System (ATS) Technology Readiness Testing—Phase 3", Document #666274, Oct. 1, 1996–Sep. 30, 1997, Publication Date, Dec. 31, 1997, Report Nos. DOE/MC/31176—10.
"Utility Advanced Turbine System (ATS) Technology Readiness Testing and Pre–Commercial Demonstration, Phase 3", Document #486029, Oct. 1–Dec. 31, 1995, Publication Date, May 1, 1997, Report Nos.: DOE/MC/31176——5340.
"Utility Advanced Turbine System (ATS) Technology Readiness Testing and Pre–Commercial Demonstration—Phase 3", Document #486132, Apr. 1–Jun. 30, 1976, Publication Date, Dec. 31, 1996, Report Nos.: DOE/MC/31176—5660.
"Utility Advanced Turbine System (ATS) Technology Readiness Testing and Pre–Commercial Demonstration—Phase 3", Document #587906, Jul. 1–Sep. 30, 1995, Publication Date, Dec. 31, 1995, Report Nos.: DOE/MC/31176—5339.
"Utility Advanced Turbine System (ATS) Technology Readiness Testing and Pre–Commercial Demonstration" Document #666277, Apr. 1–Jun. 30, 1997, Publication Date, Dec. 31, 1997, Report Nos.: DOE/MC/31176—8.
"Utility Advanced Turbine System (ATS) Technology Readiness Testing and Pre–Commercialization Demonstration", Jan. 1–Mar. 31, 1996, DOE/MC/31176—5338.
"Utility Advanced Turbine System (ATS) Technology Readiness Testing: Phase 3R", Document #756552, Apr. 1–Jun. 30, 1999, Publication Date, Sep. 1, 1999, Report Nos.: DE—FC21–95MC31176–23.
"Utility Advanced Turbine System (ATS) Technology Readiness Testing.", Document #656823, Jan. 1–Mar. 31, 1998, Publication Date, Aug. 1, 1998, Report Nos.: DOE/MC/31176–17.
"Utility Advanced Turbine Systems (ATS) Technology Readiness Testing and Pre–Commercial Demonstration", Annual Technical Progress Report, Reporting Period: Jul. 1, 1995–Sep. 30, 1996.
"Utility Advanced Turbine Systems (ATS) Technology Readiness Testing", Phase 3R, Annual Technical Progress Report, Reporting Period: Oct. 1, 1997–Sep. 30, 1998.
"Utility Advanced Turbine Systems (ATS) Technology Readiness Testing", Document #750405, Oct. 1–Dec. 30, 1998, Publication Date: May, 1, 1999, Report Nos.: DE–FC21–95MC31176–20.
"Utility Advanced Turbine Systems (ATS) Technology Readiness Testing", Document #1348, Apr. 1–Jun. 29, 1998, Publication Date Oct. 29, 1998, Report Nos.: DE–FC21–95MC31176—18.
"Utility Advanced Turbine Systems (ATS) Technology Readiness Testing—Phase 3", Annual Technical Progress Report, Reporting Period: Oct. 1, 1996–Sep. 30, 1997.
"Utility Advanced Turbine Systems (ATS) Technology Readiness Testing and Pre–Commercial Demonstration", Quarterly Report, Jan. 1–Mar. 31, 1997, Document #666275, Report Nos.: DOE/MC/31176–07.
"Proceedings of the 1997 Advanced Turbine Systems", Annual Program Review Meeting, Oct. 28–29, 1997.

* cited by examiner

MULTIPLE RESPONSE OPTIMIZATION

DESIGN VARIABLES

| Name | Lower Limit | Upper Limit | Starting/New Value |
|---|---|---|---|
| B content | 40 | 130 | 40.0150415 |
| Solution Temp | 2280 | 2310 | 2280.083312 |
| | | | |
| | | | |
| | | | |
| | | | |
| | | | |

CONSTRAINTS (relationships between X's)

| | Name | Formula f(x) | <=,>=, or = | Requirement (number) |
|---|---|---|---|---|
| C1 | | 0 | | |
| C2 | | | | |
| C3 | | | | |
| C4 | | | | |
| C5 | | | | |
| C6 | | | | |
| C7 | | | | |
| C8 | | | | |

SOLUTION

| | |
|---|---|
| B content | 40.015 |
| Solution Temp | 2280.08 |
| | |
| | |
| | |
| | |
| | |
| | |
| | |
| | |

Before hitting the "Solve!" button, be sure to open the Solver from the Tools Menu. Then click "Cancel".

GOALS/TRANSFER FUNCTIONS

| | Name | Formula f(x) | <=,>=, or = | Target (Value) | Max. Value |
|---|---|---|---|---|---|
| G1 | Yield | 98.99993519 | >95 | 99 | 100 |
| G2 | Creep | 84.78501253 | >95 | 99 | 100 |
| G3 | Transverse | 51.09135465 | >95 | 99 | 100 |
| G4 | | | | | |
| G5 | | | | | |
| G6 | | | | | |
| G7 | | | | | |
| G8 | | | | | |

To HALT the solver at any time, press the "ESC" key

<= means less than or equal to;
>= means greater than or equal to.

COPYRIGHT 1997
Dr. Maurice L. Berryman
All Rights Reserved.

OPTIMIZATION PRIORITIES

| | |
|---|---|
| 6.048068E-07 | Priority Level 1 |
| 0.0142049875 | Priority Level 2 |
| | Priority Level 3 |

Figure 8

NICKEL BASE SUPERALLOYS AND TURBINE COMPONENTS FABRICATED THEREFROM

This a division of application Ser. No. 09/794,220 filed Feb. 28, 2001, abandoned, which claims benefit of provisional application No. 60/185,696 filed Feb. 29, 2000.

The present invention relates to directionally solidified nickel-base superalloys alloys having improved heat treat characteristics, good high temperature longitudinal and transverse creep strength properties, good hot corrosion resistance and resistance to oxidation. The invention also relates to the use of the alloys in the fabrication of turbine components, particularly large turbine buckets and turbine blades for aircraft engines.

BACKGROUND OF THE INVENTION

It is known to employ nickel base superalloys in the fabrication of aircraft engine components. To be acceptable, such alloys must exhibit good castability with no heat treat cracking, good high temperature longitudinal and transverse creep strength properties and good hot corrosion resistance.

One such nickel base superalloy employed as a turbine blading material in aircraft engines is single crystal (SC) Rene N4 alloy. A form of SC Rene N4 is described in U.S. Pat. No. 5,154,884 as a nickel-base superalloy composition comprising, by weight, 7–12% Cr, 1–5% Mo, 3–5% Ti, 3–5% Al, 5–15% Co, 3–12% W, up to 10% Re, 2–6% Ta, up to 2% Cb, up to 3% V, up to 2% Hf, the balance being essentially nickel and incidental impurities. U.S. Pat. No. 5,399,313 describes a modified version of SC Rene N4 as comprising, by weight, 9.5–10.0 Cr, 7.0–8.0 Co, 1.3–1.7 Mo, 5.75–6.25 W, 4.6–5.0 Ta, 3.4–3.6 Ti, 4.1–4.3 Al 0.4–0.6 Cb, 0.1–0.2 Hf, 0.05–0.07 C and 0.003–0.005 B, the balance being nickel and incidental impurities.

Typically, aircraft engine blades are small, on the order of a few inches long, and weigh a few ounces, or a few pounds at most. Power turbine buckets, by contrast, are typically up to about 36 inches long, and weigh up to about 40 pounds. It has been found that use of single crystal alloys for such large parts is impractical. A need exists for a superalloy for use in the fabrication of large turbine blades which exhibits good castability with no heat treat cracking, good high temperature longitudinal and transverse creep strength properties and good hot corrosion resistance. The present invention seeks to satisfy that need.

SUMMARY OF THE INVENTION

The present invention is directed to an alloy and high temperature heat treatment for buckets fabricated from nickel base superalloys that will allow the buckets to be used for extended periods, typically up to about 72,000 hours in a power turbine. It is has been found that such an extended turbine life can be achieved if approximately 60–80% solutioning of the gamma-prime precipitates in the alloy occurs. The gamma-prime precipitates provide the strengthening phase for the alloy. Moreover, it has been discovered according to the invention that adjusting the level of boron in the alloy of the invention to within the range of about 70–130 ppm, generally about 80–130 ppm, more usually about 80–100 ppm (about 0.0080–0.01 weight %), for example about 90 ppm (about 0.009 weight %), results in a reduction in the incidence of heat treat cracking in the cast buckets.

In a first aspect, there is provided a nickel base superalloy suitable for the production of a large, sound, crack-free nickel-base superalloy gas turbine bucket suitable for use in a large land-based utility gas turbine engine, comprising or consisting essentially of, by weight percents:

Chromium 7.0 to 12.0
Cobalt 5.0 to 15.0
Carbon 0.06 to 0.10
Titanium 3.0 to 5.0
Aluminum 3.0 to 5.0
Tungsten 3.0 to 12.0
Molybdenum 1.0 to 5.0
Boron 0.0080 to 0.013
Rhenium 0 to 10.0
Tantalum 2.0 to 6.0
Columbium 0 to 2.0
Vanadium 0 to 3.0
Hafnium 0 to 2.0 and
Remainder nickel and incidental impurities.

A typical nickel base alloy of the invention comprises or consists essentially of, in weight percent:

Chromium 9.50–10.00
Cobalt 7.00–8.00
Aluminum 4.10–4.30
Titanium 3.35–3.65
Tungsten 5.75–6.25
Molybdenum 1.30–1.70
Tantalum 4.60–5.00
Carbon 0.06–0.10
Zirconium 0.01 max (no min)
Boron 0.008–0.010 (also expressed as 80–100 parts per million (ppm))
Iron 0.20 max (no min)
Silicon 0.20 max (no min)
Manganese 0.01 max (no min)
Copper 0.10 max (no min)
Phosphorus 0.005 max (no min)
Sulfur 0.003 max (no min)
Columbium 0.40–0.60
Oxygen 0.002 max (no min)
Nitrogen 0.0015 max (no min)
Vanadium 0.10 max (no min)
Hafnium 0.10–0.20
Platinum 0.15 max (no min)
Rhenium 0.10 max (no min)
Rhenium+Tungsten 6.25 max (no min)
Magnesium 0.0035 max (no min)
Palladium 0.10 max (no min)
Nickel Remainder In a further aspect, there is provided a method of making a cast and heat treated article such as a large power turbine bucket of a nickel-base superalloy of the invention, wherein the article is heated in an argon atmosphere or in vacuum to develop 60–80 percent solutioning of gamma prime precipitate, followed by cooling to room temperature. Typically, the article is heated to a temperature of about 2260° F.–2300° F., but at least about 25° F. below the incipient melting temperature of the superalloy. The article may be cooled by a furnace cool at a cooling rate of about 35° F./minute to 2050° F., followed by gas fan cooling at nominally 100° F./minute to 1200° F., and then any cooling rate to room temperature.

In yet a further aspect, the invention provides an article, such as a large turbine bucket, produced according to the method of the invention.

In a further aspect, there is provided a gas turbine engine containing an article of the present invention.

The alloy of the invention exhibits several advantages. First, at 90–130 ppm boron the alloy of the invention has better castability (for large turbine buckets) than SC Rene N4 at 30–50 ppm boron. Secondly, at 90–130 ppm boron in DS form the alloy of the invention has an improved yield over SC Rene N4 at 30–50 ppm boron. In regard to "yield", SC Rene N4 implies one grain per part. SC Rene N4 is typically used to make small turbine blades. As small parts go, it is possible to have a true "single crystal." However, for large components, it is difficult to actually produce a part with only one grain. Thus, "yield" for a SC part would be near zero (i.e. it is not possible to fabricate any). By changing the composition of SC Rene N4 primarily by adding more boron, it is possible to make a multi-grained DS component. This multi-grained DS component is designed to accommodate many grains across the cross-section of the part. Made in this manner, the "yield" increases to 80–100%.

Thirdly, at 90–130 ppm boron, the alloy of the invention has nominally equivalent mechanical properties (in the longitudinal direction) to the SC Rene N4 at 30–50 ppm boron. Fourthly, at 90–130 ppm boron, the alloy of the invention has better transverse creep properties than SC Rene N4 at 30–50 ppm. Fifthly, at 90 ppm boron, the alloy of the invention has better resistance against heat treat cracking than either the SC Rene N4 at 30–50 ppm boron or the 130 ppm boron DS alloy of the invention. The alloy with 130 ppm boron has a lower melting point (approx. 2301° F.) than DS Rene N4 or DS Rene N4 with 90 ppm boron (m.p. approx. 2315° F.), or SC Rene N4 which has a melting point near 2334° F. (Melting points: DS Rene N4 with 130 ppm boron—2301° F.; DS Rene N4 with 90 ppm boron—2315° F.; SC Rene N4 with 30–50 ppm boron—2334° F.).

BRIEF DESCRIPTION OF THE DRAWINGS

The invention will now be described in more detail with reference to the accompanying drawings, in which:

FIG. 8 is a Multiple Response Optimization spreadsheet for showing the relationship between transverse creep strength and boron content.

DETAILED DESCRIPTION OF THE INVENTION

Figure 1:
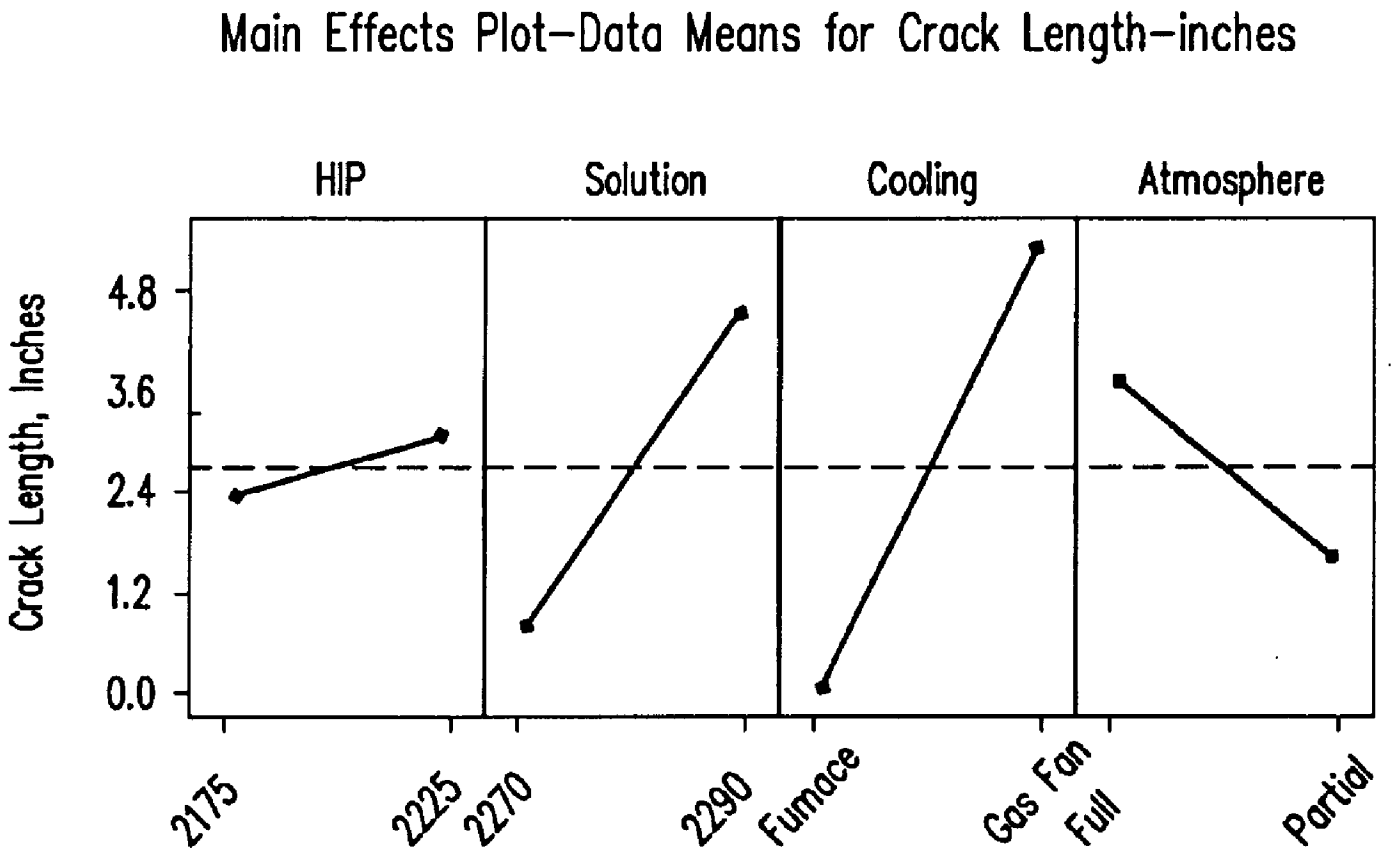
FIG. 1 is a series of plots showing the effect of different processing conditions on crack length in a MS7001 H turbine bucket.

It has been found, according to the invention, that increasing the boron from about 30–50 ppm in the SC Rene N4 specification to no greater than 130 ppm boron, along with several changes in part configuration, including bucket shape, essentially eliminates casting cracks in large turbine buckets. The additional boron may create a "$M_5B_3$" phase where M is Ni or $Ni_5B_3$ eutectic phase in the grain boundaries and elsewhere within the alloy matrix (as determined by Auger Spectrometry and Microdiffraction analyses), and the melting properties of the alloy have been attributed to the presence of a "$M_5B_3$" boron phase. The presence of this eutectic phase lowers the incipient melting point (the point at which the metal starts to melt) from 2334° F. to 2301° F. (as determined by Differential Thermal Analysis (DTA)). Thus, after application of a 2320° F. heat treatment (normal for SC Rene N4), the DS alloys begin to melt at locations within the eutectic pools where the boron as $Ni_5B_3$ is concentrated. Many of these eutectic pools are in the grain boundaries, and can be more segregated than those eutectic pools elsewhere within the grains. When the eutectic melting starts and the bucket cools back down to room temperature, a linear imperfection defined as a crack may be created. These cracks, called heat treat cracks, may be several inches long but may not be visible to the unaided eye. The heat treat cracks may be found by use of fluorescent penetrant inspection (FPI), a nondestructive inspection technique.

The inventors have carried out work to determine parameters with respect to the boron content of the alloy. It has been found that boron at 30–50 ppm in the alloy of the invention is not particularly suitable for castability of large buckets. At this level of boron, a 2320° F. heat treatment fully solutions the gamma-prime phase and provides optimum longitudinal mechanical properties for long bucket life. However, at this low level of boron, the transverse creep properties are less than optimum for large buckets.

In contrast, boron at 130 ppm in the alloy has been found to be suitable for castability, but is not particularly suitable for a full solution heat treatment. The melting point of such an alloy is reduced to about 2301° F., and the highest heat treatment that may be reliably applied is 2280° F. if melting is to be avoided. Heat treatment at a temperature of 2280° F. provides only about 60–80% solutioning of the gamma-prime phase, but this is generally acceptable for a full-life bucket. Thus, the gamma-prime phase in the 130 ppm boron material cannot be fully solutioned because the alloy starts to melt before full solutioning can be achieved.

The transverse creep properties are acceptable with this higher level of boron of 130 ppm. However, at this level of boron, a 5% failure rate for heat treat cracking has been observed.

It has been found that a level of boron of about 80–100 ppm, i.e. about 90±10 ppm, is optimum for castability. In order to improve the longitudinal creep properties for an improved margin for bucket life, an increase in the percent gamma-prime solutioning over about 60–80% is desired. This may be possible due to the increase in melting temperature for the intermediate (about 90 ppm) boron level. In addition, this 90 ppm level of boron provides a greater margin against heat treat cracking, and increases the yield during the solution heat treatment operation.

Castability experiments have been performed using the procedure described in U.S. Pat. No. 4,169,742 (herein incorporated by reference). A master "lean" heat of DSN4 was formed, where B and Zr were removed, but otherwise the remaining elements (except for C and Hf) were the same as in SC Rene N4 as described above. A three-level, four-factor designed experiment (DOE) was then carried out. Castability was examined using the aforementioned castability test with the grain boundary strengthening elements (& Ti) at the following levels (Zr was not varied but kept at the lowest level), as shown in the Table below:

| Weight Percent of Elements at the 3 levels Desired for DOE Experiment | | | |
|---|---|---|---|
| Element | Low Level | Medium Level | High Level |
| Carbon | 0.06 | 0.10 | 0.14 |
| Hafnium | 0.25 | 0.45 | 0.65 |
| Boron | 0.0075 (75 ppm) | 0.01 (100 ppm) | 0.015 (150 ppm) |
| Titanium | 3.37 | 3.50 | 3.65 |

It has been determined that castability is improved if Hf and Ti are run at their highest levels, but this also depends upon the B content. The differences between C and B could not be fully ascertained because this was not a full factorial experiment (which would have been 3×3×3×1×3 or 81 experiments), and due to the limited ranges of carbon (0.14%−0.06%=0.08%) and boron (0.015%−0.0075%=0.0075%) versus ranges for hafnium (0.65%−0.25%=0.45%) and titanium (3.65%−3.37%=0.28%).

Hafnium (Hf) is known to cause casting defects known as "bands", which are transverse linear indications as determined during FPI examination. It has been determined that 0.75% Hf causes bands in low or high boron DS Rene N4 (boron 30–50 ppm—or 80–130 ppm), whereas 0.25 weight % Hf and 0.45 weight % Hf resulted in no bands. From the standpoint of acceptable transverse creep ductility, the lower level of Hf in production buckets is not allowed to fall below 0.15 weight %. Thus, for DS Rene N4, Hf is generally maintained in the range of about 0.15–0.45 weight %.

Experiments have been carried out using controlled amounts of boron and hafnium added to a baseline N4 master heat to determine their effect on castability, expressed as total inches of crack length. The master heat composition was, by weight, 0.04% C, 9.77% Cr, 7.49% Co, 5.92% W, 1.51% Mo, 4.21% Al, 3.37% Ti, 0.45% Nb, 4.71% Ta, 0.16% Hf, 0.00% B, less than 0.005% Zr, balance Ni. The results for thin wall castings (about 60 mils thick) and thick wall castings (about 120 mils thick) are shown in the chart below. The least amount of cracking (expressed as inches of crack) is best.

| "Inches of Crack Length from Castability Test" | | | | | |
|---|---|---|---|---|---|
| | | 0.00 | | 0.15 | 0.45 |
| | | Thin Wall Hf | | | |
| B | 0.004 | 5.6 | 7.4 | 11.2 | 18.9 |
| | | 5.4 | 7.4 | 11.0 | 15.3 |
| | | | 9.6 | | |
| | 0.009 | | 19.4 | | |
| | | | 14.1 | | |
| | 0.013 | | 13.8 | | 10.8 |
| | | | 13.9 | | |
| | | Thick Wall Hf | | | |
| B | 0.004 | 7.0 | 6.3 | 5.5 | 17.0 |
| | | 5.0 | 5.7 | 11.1 | 13.8 |
| | 0.009 | | 10.4 | | |
| | | | 13.3 | | |
| | 0.013 | | 15.2 | | 8.4 |
| | | | 12.2 | | |

Boxed data sets from "scratch" heats

Other heats made by doping master lean heat

The chart above shows that thin wall versus thick wall data are comparable, and that best castability is observed for DS Rene N4 with 40 ppm (0.004%) boron and no Hf, OR 130 ppm (0.013%) boron and 0.45% Hf, indicating there is a "saddle point" in the data. No Hf is not considered to be acceptable as it may decrease transverse creep ductility. It has been found that castability of the 90 ppm boron alloy with 0.15% Hf is improved over the castability of 130 ppm boron material with 0.15% Hf. Higher Hf levels may create transverse "bands" or dross. Banding as noted earlier is a known casting flaw, and "dross" is a nonmetallic inclusion caused by a chemical reaction between dissolved oxygen in the metal and free hafnium in the metal which combine to form a stable oxide such as $HfO_2$ (hafnium oxide). In either case, lower Hf (typically 0.15–0.45 weight %) is desirable in creating defect-free castings.

The method of the invention includes a ramp heat treatment up to the solution heat treatment temperature plus the post-solution heat treatment cooling rate down to room temperature. Four factors are important to achieving reduced heat treatment cracking. Each has been investigated at two levels, as discussed below.

HIP temperature (2175° F. or 2225° F.);

solution heat treat temperature (2270° F. or 2290° F.);

post-solution heat treatment temperature cooling rate (slow furnace cool at about 35° F./minute or fast gas fan cool at about 150° F./minute, both followed by gas fan cooling from a temperature of about 2050° F.); and solution heat treatment atmosphere (vacuum or argon gas).

HIP or "hot isostatic pressing" is a means by which internal porosity in the casting can be closed by the application of external pressure. This is achieved in a HIP vessel. The porosity is closed by the application of temperatures in the range of 2175° F.–2225° F. and 15,000 psi for an alloy like SC or DS Rene N4.

A heat treat temperature of 2290° F. was chosen as the highest temperature possible for the solution heat treatment. The temperature of 2290° F. was reached using part of a RAMP4 cycle to 2290° F., which is set forth in the Table which follows:

| Typical RAMP4 Solution Heat Treatment Cycle to 2300 F. | | | | |
|---|---|---|---|---|
| Ramp Rate | Hold Temp. | Hold Time | Heating Rate | Purpose/Results |
| 25 F./minute | 1400 F. | 10 mm. | — | Stabilize, and begin introducing 800 microns of argon gas. Not used if already |

-continued

Typical RAMP4 Solution Heat Treatment Cycle to 2300 F.

| Ramp Rate | Hold Temp. | Hold Time | Heating Rate | Purpose/Results |
|---|---|---|---|---|
| | | | | running in a 100% argon atmosphere. |
| 25 F./minute | 2225 F. | 8 hour | Increase to | homogenize |
| 25 F./hour | 2250 F. | 4 hours | Increase to | homogenize |
| 30 F./hour | 2280 F. | 2 hours | Increase to | homogenize |
| 10 F./hour | 2290 F. | 2 hours | Increase to | homogenize |
| 10 F./hour | 2300 F. | 0.5 hours | Cool to RT | Achieve final gamma-prime solutioning |

This heating cycle was chosen because there was no evidence of melting or heat treat cracking using a variety of bucket or ingot sizes. For the 2290° F. solution cycle, that part of the RAMP4 cycle above (including up to 2290° F./2 hours) was chosen. A temperature of 2290° F. was chosen because previous work by the inventor showed that at 2300° F., recrystallized grain (RX) defects could form in DS Rene N4, and to avoid the RX grains the temperature would have to be lowered. Since it is only possible to control the temperature to within 10° F., a temperature of 2290° F. was chosen as the highest practical heat treatment temperature.

The second solution heat treatment temperature was 2270° F. This was based upon metallography photographs showing the percent of gamma-prime solutioning, and was considered to be the lowest acceptable temperature capable of providing a full-life bucket.

The results are set forth in FIG. 1. Heat treating at 2270° F.±10° F. was equivalent to heat treating in the range of 2260–2280° F., and heat treating at 2290F.±10° F. was equivalent to heat treating in the range of 2280–2300° F.

A reason that it is difficult to determine what causes heat treat cracking is because the buckets cannot be examined at the solution heat treatment temperature to see if they are cracked. It is necessary to cool the buckets down to room temperature for examination. In addition, the section size of the bucket has some effect on residual stress, which further complicates the heat treat cracking issue.

The HIP temperature was probably not significant because it is well below the incipient melting temperature. Furthermore, the HIP cycle is also a thermal cycle and therefore can provide some homogenization to the DS Rene N4. In this case, the 2225° F. cycle would provide more homogenization than the 2175° F. cycle. But based upon the experimental analysis, it was shown the amount of homogenization provided by either HIP cycle is inadequate to influence the heat treat cracking.

In addition to the previous HIP and solution heat treat cycles, the cooling rate was believed to have an effect on heat treat cracking. To investigate this, two cooling rates were employed. The first rate was produced from a gas fan cool in the range of 100–150° F./minute, which is available on most vacuum furnaces. The second rate was selected because it was used during development trials, specifically from Ramp 4 heat treatment where gas fan cooling was not available—only natural cooling was available (called furnace cooling). Furnace cooling is achieved by just turning off the furnace and letting it cool naturally. In this case, the range was measured to be 35–75° F./minute.

Finally, the furnace atmosphere was felt to be important. Two atmospheres are commonly available. The first is a vacuum atmosphere with some argon backfill, in the range of 400–800 microns. The second atmosphere that is commonly employed (and was used in RAMP 4 heat treat) was 100% argon (not a vacuum).

The furnace environment during the heat treat experiment was determined to be a minor factor. Initially, it was thought a vacuum or partial vacuum environment could cause heat treat cracking by volatilizing the grain boundary elements, in this instance, during a vacuum heat treatment, some elements with a low vapor pressure can be removed from the alloy, possibly leaving void spaces such as along a grain boundary (which could be interpreted as a crack). However, neither atmosphere (vacuum with partial pressure argon or 100% argon) had a significant effect on the heat treat cracking of the DS Rene N4 buckets.

FIG. 1 shows that the cooling rate has the greatest influence on the heat treat cracking, followed closely by the solution heat treatment temperature (the greater the slope, the larger the effect). The other two factor—HIP temperature and furnace atmosphere—are considered to be minor factors. Thus, the slower cooling rate and the lower solution heat treatment temperature afforded the best results (least amount of heat treat cracking).

When the alloy is DS Rene N4 alloy with 130 ppm boron, the optimum heat treatment includes a HIP cycle at 15,000 psi for 4 hours in the range of 2175–2225° F. followed by a solution heat treatment temperature in the range of 2270° F. to 2290° F., followed by a furnace cool of about 35° F./minute to about 2050° F. and gas fan cooling to less than 1200° F., to prevent heat treat cracking.

The solution temperature had the largest effect on heat treat cracking, and is generally 2280° F.±10° F. (i.e. 2270° F.–2290° F.), more usually 2280° F. This provides for a lower incidence of heat treat cracking while still achieving adequate gamma-prime precipitate solutioning.

The cooling rate is generally in the range of 25–45° F./minute, for example 35° F./minute. The gas fan cooling may be initiated when the temperature reaches approximately 2050° F.±50° F.

The furnace atmosphere may be 100% argon, or vacuum plus argon partial pressure (400–800 microns). Vacuum plus argon partial pressure (400–800 microns) is generally employed. The use of this small amount of argon helps reduce the vaporization (depletion) of chromium during the heat treat cycle.

From this 130 ppm boron group, 1 cracked bucket occurred out of 19 total, or a 5.2% failure rate, due to heat treat cracking. Part of the reason for this is the small margin of error between the heat treat temperature (2280° F.) and the incipient melting point of this alloy (2301° F.). The temperature difference between heat treat temperature and melting point is 2301–2280° F.=21° F. This small margin is less than the error of thermocouples, which would approach 1% of the actual temperature, or at 2280° F. it would be 22.8° F. This means the actual heat treat temperature could exceed the true melting point of the alloy, without the furnace operator's knowledge. If that happened, it would cause incipient melting, which in the presence of residual stress may lead to heat treatment cracks. This is compared to a margin of 54° F. for the 40 ppm boron material between the heat treat temperature and the potential for incipient melting and heat treat cracking (2334° F.–2280° F.=54° F.)

The margin for temperature error with a 2280° F. heat treatment is shown in the Table below.

| DSN4/GTD444 Alloys | Incipient Melting Point (° F. on heating) | Aim Heat Treat Temperature (° F.) | Margin for Temp. Error during Heat Treatment (° F.) |
|---|---|---|---|
| DSN4 w/31 ppm Boron | 2346 | 2280 | 66 |
| DSN4 w/36 ppm Boron | 2344 | 2280 | 64 |
| DSN4 w/40 ppm Boron | 2334 | 2280 | 54 |
| DSN4 w/90 ppm Boron | 2311 | 2280 | 31 |
| DSN4 w/130 ppm Boron | 2301 | 2280 | 21 |

The advantage in going to an intermediate level of boron, such as in the 80–100 ppm range, is in the margin between incipient melting (when the alloy starts to melt) at the 2280° F. heat treat temperature. For example, at 130 ppm B, there is only 21° F. between the incipient melting point and the 2280° F. heat treatment. This is not an acceptable range, because the error due to the thermocouple (TC) alone is 22.8F. (1% of 2280F.). But at 90 ppm B the range between incipient melting and the heat treat temperature has increased to 31° F. Therefore, after accounting for 22.8° F. of TC error, there is still 8.2° F. of temperature margin (31° F.–22.8° F.) between the incipient melting point and the 2280° F. heat treat temperature. While 8.2° F. of margin is not a lot, it is an equivalent margin when compared to other high-technology SC or DS alloys.

Buckets from 90 ppm boron heats were successfully heat treated at 2280° F. with 0% failure rate due to heat treat cracking. For the 90 ppm boron material, the melting point was determined to be 2311° F. Thus, with a heat treat temperature of 2280° F. the temperature difference between the heat treat temperature and the melting point is 2311–2280° F.=31° F. The temperature difference between the heat treat temperature and the incipient melting point is greater than the thermocouple error (1% of 2280° F. or 22.8° F.), so there is less opportunity for unknowingly heat treating the buckets above their incipient melting point, causing heat treat cracking.

It has been found that the amount of boron influences the incipient melting point of the alloy. i.e. less boron is better. The amount of boron additionally influences the transverse creep ductility, i.e. more boron is better (although boron does not influence the longitudinal creep ductility). Moreover, a higher solution temperature leads to more gamma prime solutioning, and more gamma prime solutioning leads to more longitudinal creep life. However, the solution temperature influences the transverse creep ductility, whereby a lower temperature is better.

Thus, optimization of the alloy requires transfer functions (equations) that describe these features in terms of controllable factors. Additionally, creep strength and casting yield are not measured in similar units. Therefore, the transfer function is expressed as a percentage of the best case for heat treat yield (100%) and creep strength (100%). The transfer function generation is described below.

Heat treat yield is a function of two variables, boron content and solution heat treatment temperature. If the B content is too high, incipient melting or heat treat cracking occurs at segregated areas in the casting, resulting in scrap. If the solution heat treatment temperature is too high, incipient melting and recrystallization (RX) limit yield. Recrystallized grains result from a phase transformation where residual strains in the material on heating cause the formation of strain-free grains with little or no strength, i.e. critical defects. The following spreadsheet shows the data used to generate Heat Treat Yield Transfer Function Equation 1:

| Heat Treat Yield (Percent) | Temp. (F.) | Boron (B) Content (ppm) |
|---|---|---|
| 100 | 2280 | 40 |
| 50 | 2292 | 130 |
| 50 | 2310 | 40 |
| 90 | 2280 | 130 |
| 0 | 2327 | 40 |
| 0 | 2310 | 130 |

Regression with the data leads to the following regression equation:

$$\text{Heat Teat Yield}=5448-2.34(\text{Temp})-(0.340)*(\text{Boron content}) \quad \text{Eq. 1}$$

This is the first transfer function for yield.

A statistical analysis was conducted for the data, resulting in the following standard tables:

| Predictor | Coef | StDev | T | P | VIF |
|---|---|---|---|---|---|
| Constant | 5448.0 | 671.8 | 8.11 | 0.004 | |
| Temp | −2.3353 | 0.2907 | −8.03 | 0.004 | 1.1 |
| B | −0.3398 | 0.1117 | −3.04 | 0.056 | 1.1 |

$S$=11.59R–Sq.=95.6% R–Sq.(Adj)=92.6%

(R–Sq=$R^2$ or R squared; adj means Adjusted)

The next transfer function is for longitudinal creep strength. This is a function of gamma-prime precipitate solutioning versus the solution heat treatment temperature, as the only way to get 100% creep strength is to fully solution the material. The following is data relating the percent of full creep strength versus the heat treat temperature for DS Rene N4:

| Creep Strength (Percent) | Heat Treat Temperature (F.) |
|---|---|
| 100 | 2320 |
| 90 | 2300 |
| 60 | 2280 |
| 40 | 2215 |

The longitudinal creep strength is in percent of maximum obtainable, and the heat treatment temperature (t) is the solution heat treatment temperature in degrees F.

Figure 2:
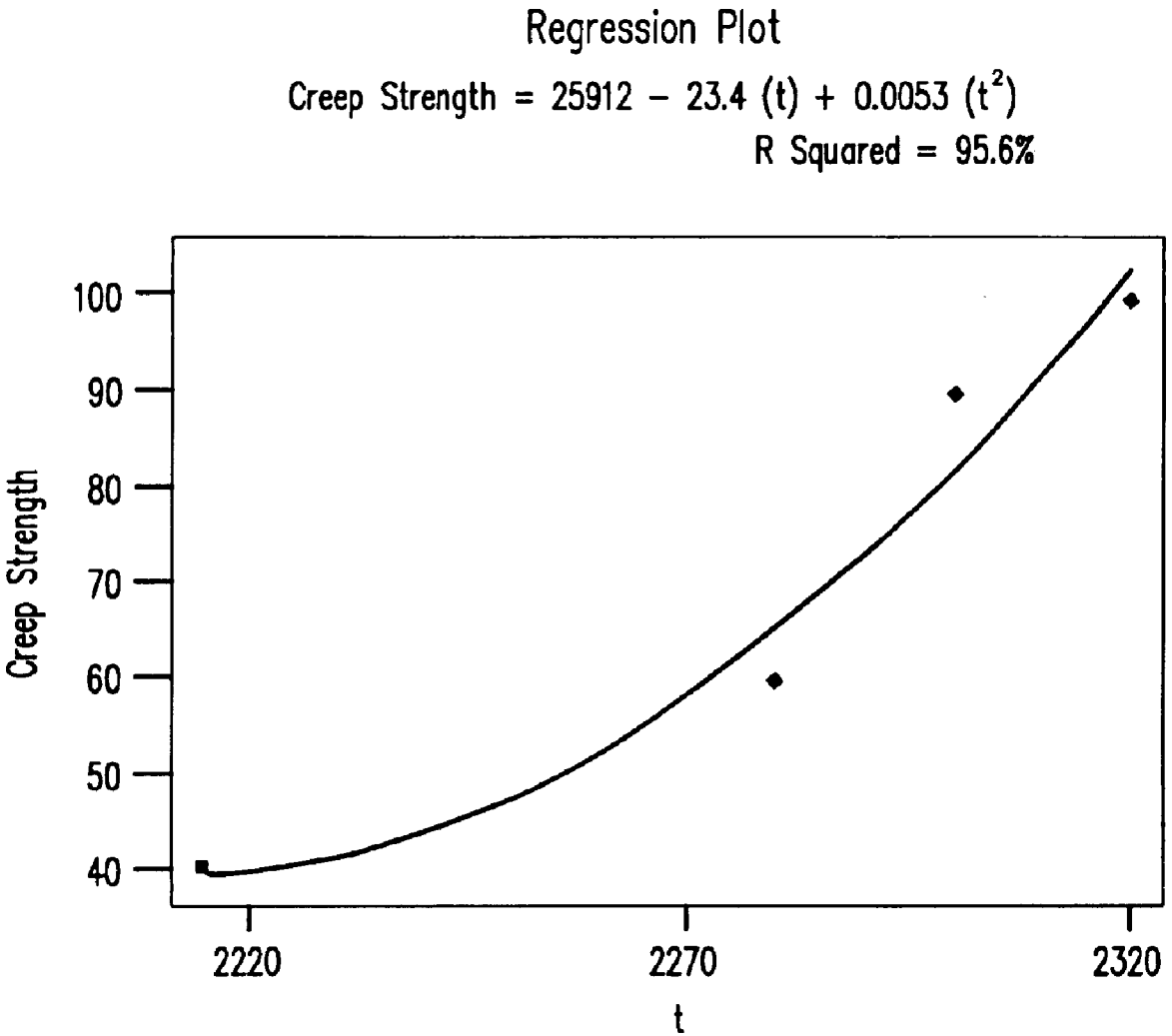
FIG. 2 is a regression plot showing creep strength as a function of temperature.

The data was used to solve for Equation 2 (see the Regression Plot in FIG. 2). The curve has the correct dependency of creep strength on solution heat treatment temperature. It will be noted that as-cast DS Rene N4 has about 40% of the possible creep strength and that solution heat treatment of DS Rene N4 at 2320° F. gives 100% creep strength. This is the second transfer function.

A further important feature of the alloy is creep strength transverse (transverse creep strength) to the grain boundaries. This is important in the tip shroud and other areas where loading is not in a radial direction on the part. The following data was extracted for transverse creep strength:

| Percent of Transverse Creep Strength. | Boron Content (ppm) |
|---|---|
| 50 | 40 |
| 100 | 80 |
| 80 | 130 |
| 90 | 100 |

Figure 3:
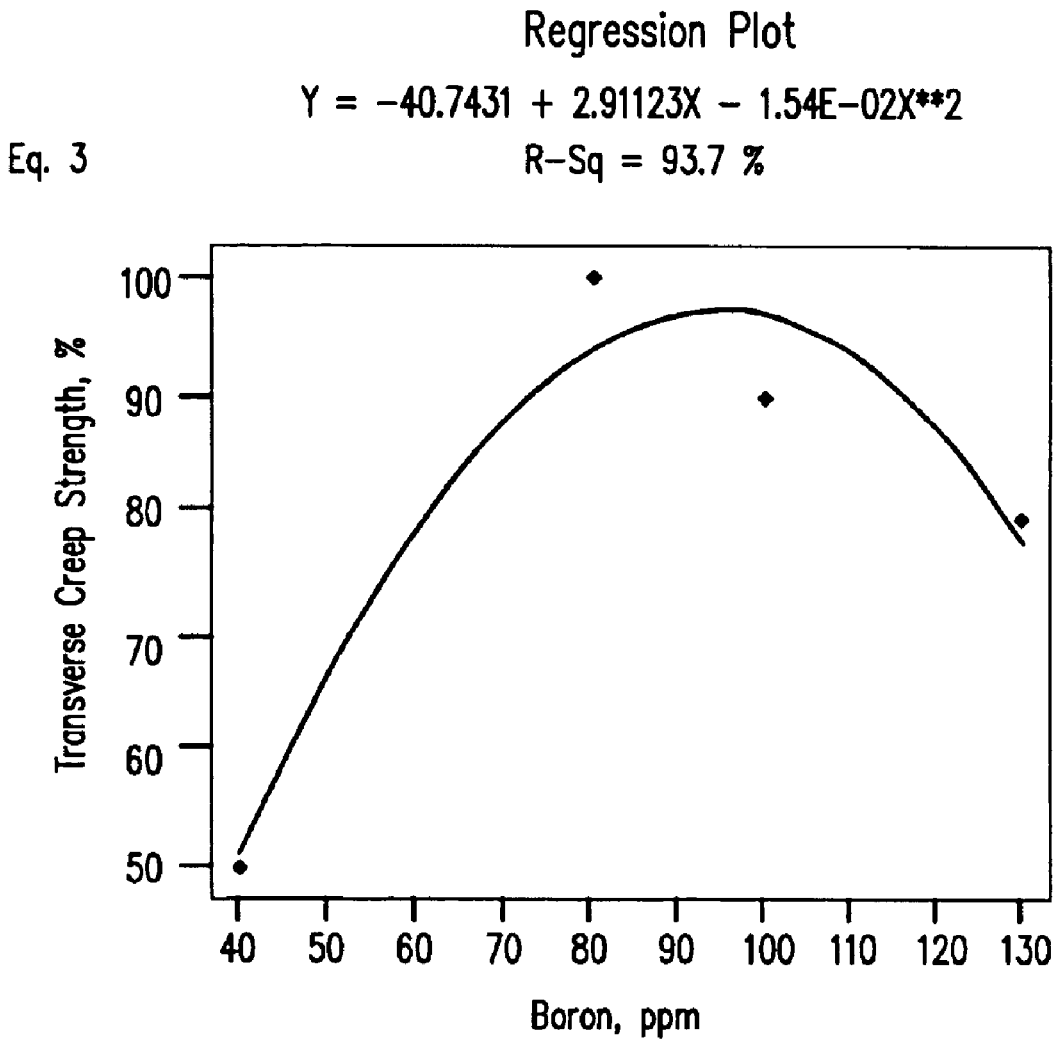
FIG. 3 is a regression plot showing transverse creep strength (%) as a function of boron content (ppm)

This information created a non-linear regression plot as shown in FIG. 3. Equation 3 is:

$$Y=-40.7431+2.9113X-1.54E-02X^2$$

The three transfer functions (equations) can be solved simultaneously using an optimization spreadsheet show in FIG. 8.

The solutions with respect to Heat Treat Yield, Longitudinal Creep and Transverse Creep Strength were:

| | Needs | | | | | |
|---|---|---|---|---|---|---|
| Heat Treat Yield | 1 | 1 | 2 | 2 | 3 | 3 |
| Longitudinal Creep Strength | 2 | 3 | 1 | 3 | 1 | 2 |
| Transverse Creep Strength | 3 | 2 | 3 | 1 | 2 | 1 |
| Optimize B ppm | 40 | 40 | 94.5 | 94.5 | 40 | 94.5 |
| Temp F. | 2280 | 2280 | 2296 | 2280 | 2296 | 2280 |

A "1" means optimization on this need first, followed by "2" and finally "3".

This results in an optimized alloy with a boron content of 94.5+/−10 ppm and a heat treatment temperature of 2280±20° F.

Figure 4:
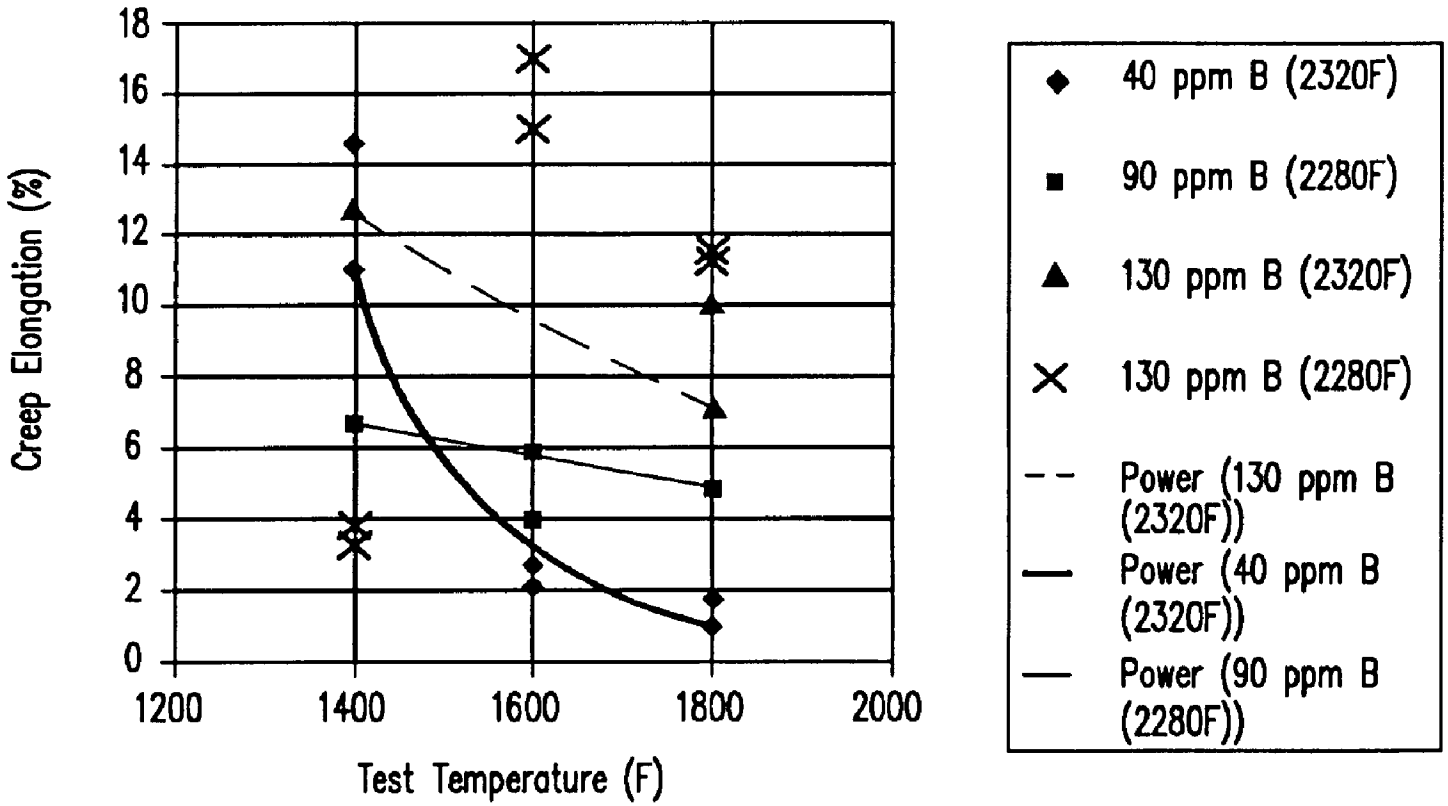
FIG. 4 is plot showing creep elongation as a function of test temperature.
Figure 5:
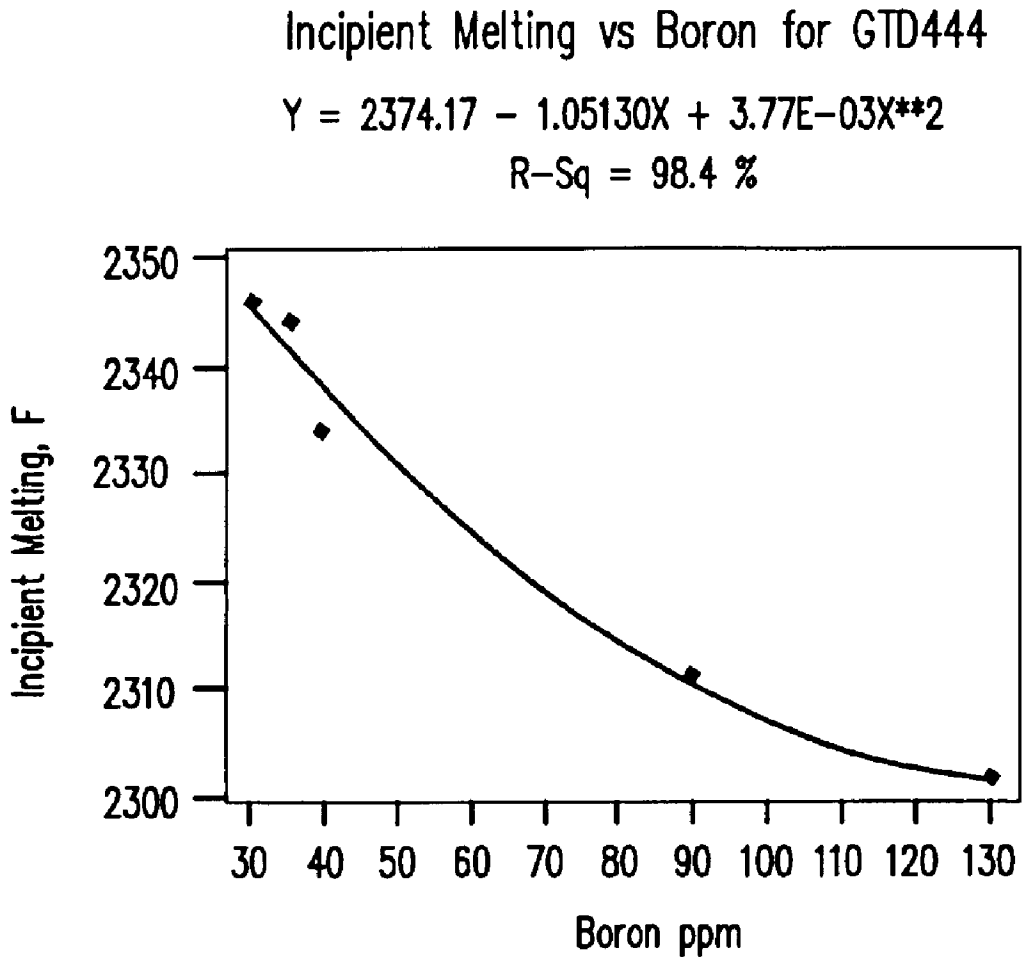
FIG. 5 is a plot showing the effect of varying amounts of boron on incipient melting of SC or DS Rene D4.

FIG. 4 is plot showing creep elongation as a function of test temperature. FIG. 5 is a plot showing the effect of varying amounts of boron on incipient melting of SC or DS Rene N4.

Figure 6:
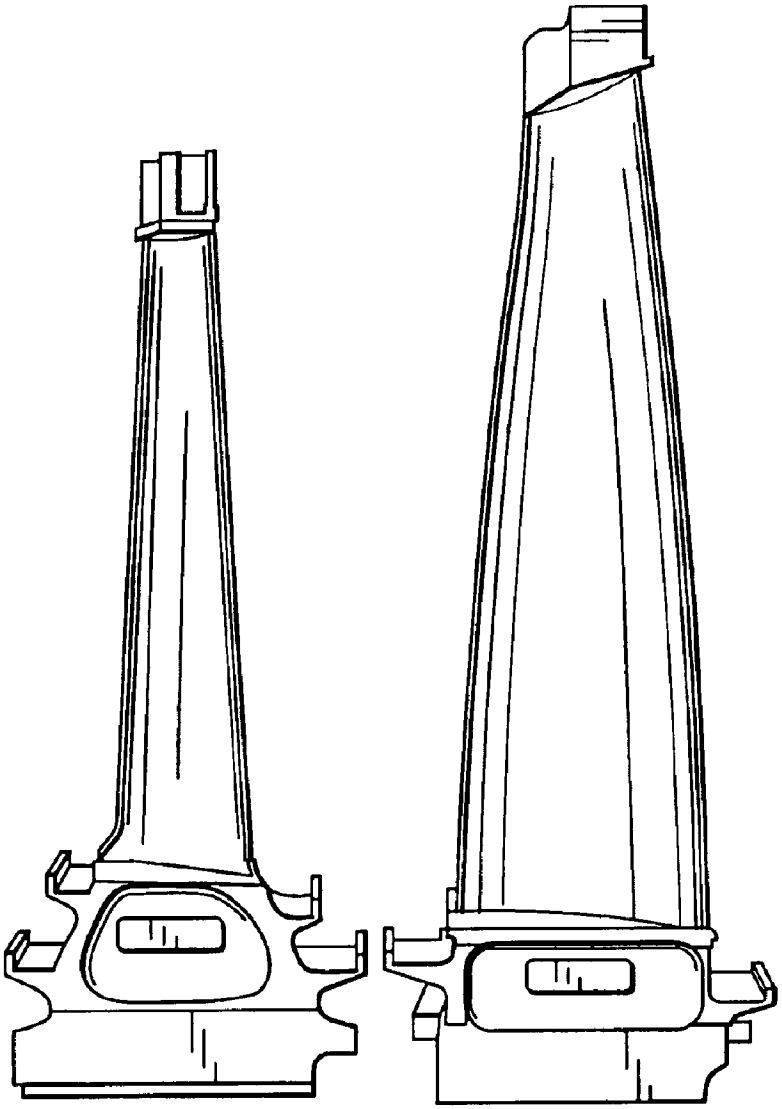
FIG. 6 shows a third and fourth stage bucket fabricated from an alloy of the invention.
Figure 7:
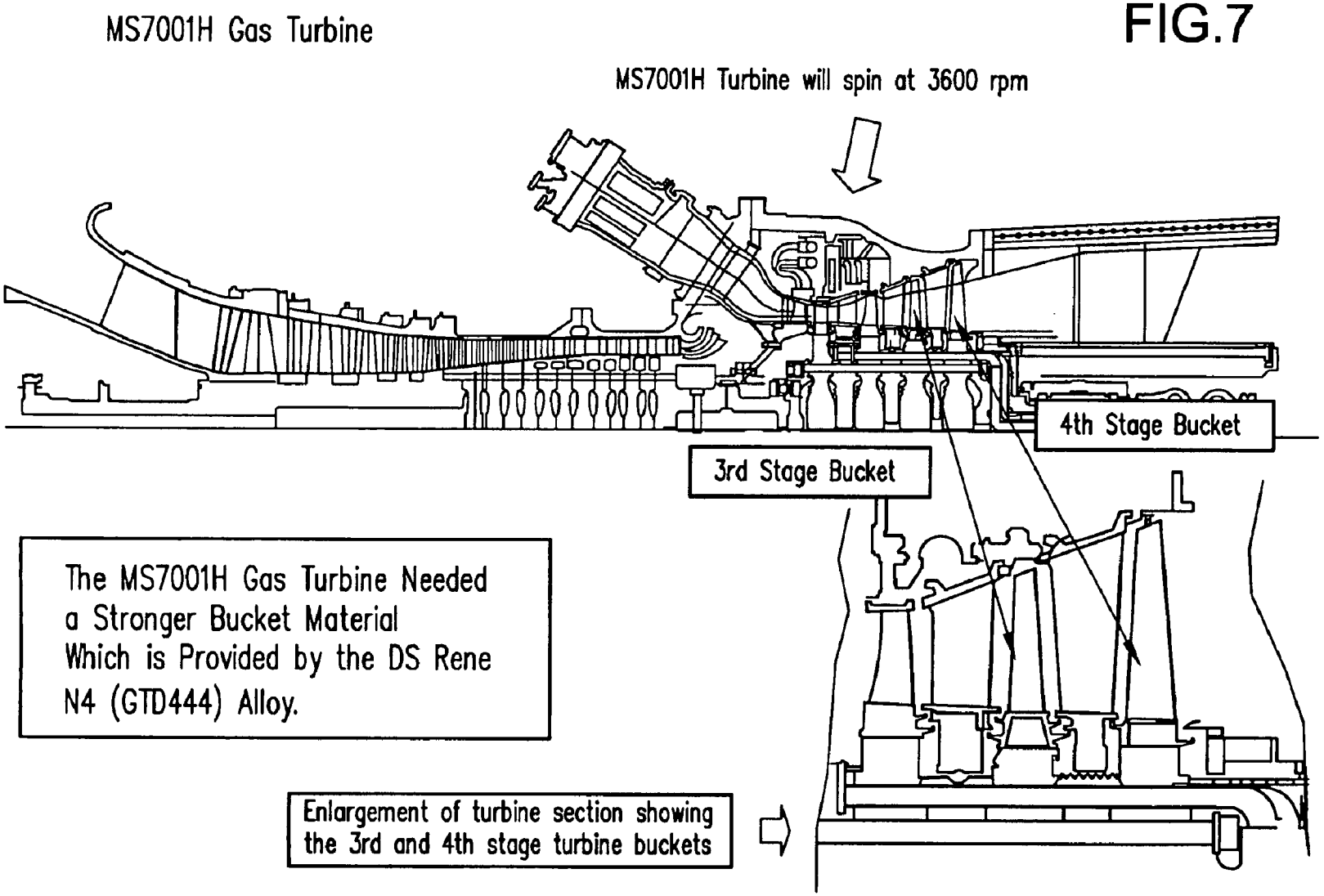
FIG. 7 is a gas turbine engine showing the location where buckets of the invention are used.

FIG. 6 shows a third and fourth stage bucket fabricated from an alloy of the invention. FIG. 7 is a gas turbine engine showing the location where buckets of the invention are used.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of making a cast and heat treated article of a nickel-base superalloy, comprising the steps of:

a) providing a superalloy, comprising, by weight percents:

Chromium 7.0 to 12.0

Carbon 0.06 to 0.10

Cobalt 5.0 to 15.0

Titanium 3.0 to 5.0

Aluminum 3.0 to 5.0

Tungsten 30 to 12.0

Molybdenum 1.0 to 5.0

Boron 0.0080 to 0.0130

Rhenium 0 to 10.0

Tantalum 2.0 to 6.0

Columbium 0 to 2.0

Vanadium 0 to 3.0

Hafnium 0 to 2.0 and remainder nickel and incidental impurities;

(b) heating the superalloy to develop at least 60 percent solutioning of gamma prime precipitate; and (c) cooling to room temperature wherein the article is cooled by a furnace cool at a rate of about 35° F./minute to about 2050° F.

2. The method according to claim 1 wherein the article is heated to a temperature of about 2260° F.–2300° F. but at least about 25° F. below the incipient melting temperature of the superalloy.

3. The method of claim 1 wherein the article is cooled by a gas fan cool at a rate of about 100–150° F./minute from below about 2050° F.

4. The method of claim 1, wherein said heating is carried out in an argon atmosphere.

5. The method of claim 1 wherein said article is a large turbine bucket.

6. The method of claim 1 wherein said article is a large aero engine turbine blade.

7. A method of making a cast and heat treated article of a nickel base superalloy, comprising the steps of:

(a) providing a superalloy comprising, by weight percents:

Chromium 7.0 to 12.0

Carbon 0.06 to 0.10

Cobalt 5.0 to 15.0

Titanium 3.0 to 5.0

Aluminum 3.0 to 5.0

Tungsten 3.0 to 12.0

Molybdenum 1.0 to 5.0

Boron 0.0080 to 0.01

Rhenium 0 to 10.0

Tantalum 2.0 to 6.0

Columbium 0 to 2.0

Vanadium 0 to 3.0

Hafnium 0 to 2.0 and remainder nickel and incidental impurities;

(b) heating the superalloy to develop at least 60 percent solutioning of gamma prime precipitate; and (c) cooling to room temperature;

wherein said heating comprises the steps of:

(i) heating said article to a temperature of about 1400° F. at a rat of 25° F./minute and holding for about 10 minutes;

(ii) heating said article in (i) to a temperature of about 2225° F. at a rate of 25° F./minute and holding for about 8 hours;

(iii) heating said article in (ii) to a temperature of about 2250° F. at a rate of 25° F./minute and holding for about 4 hours;

(iv) heating said article in (iii) to a temperature of about 2280° F. at a rate of 30° F./minute and holding for about 2 hours; and (v) cooling to room temperature.

8. The method according to claim 7 wherein the article is cooled by a furnace cool at a rate of about 350° F./minute to about 2050° F.

9. The method of claim 7 wherein the article is cooled by a gas fan cool at a rate of about 100–150° F./minute from below about 2050° F.

* * * * *